US005540357A

United States Patent [19]

Malofsky

[11] Patent Number: 5,540,357

[45] Date of Patent: Jul. 30, 1996

[54] MICROWAVEABLE ADHESIVE CHARGE COMPRISING SHAPED ADHESIVE BODY

[75] Inventor: Bernard M. Malofsky, Bloomfield, Conn.

[73] Assignee: Loctite Corporation, Hartford, Conn.

[21] Appl. No.: 288,174

[22] Filed: Aug. 10, 1994

[51] Int. Cl.[6] ..... B65D 35/56

[52] U.S. Cl. ..... 222/105; 219/759; 222/146.2; 222/146.5; 222/183; 222/325

[58] Field of Search ..... 222/92, 105, 146.2, 222/146.5, 183, 206, 215, 325; 219/759

[56] References Cited

U.S. PATENT DOCUMENTS

| | | | |
|---|---|---|---|
| 3,784,039 | 1/1974 | Marco | 222/105 |
| 5,049,714 | 9/1991 | Beresniewicz et al. | 219/759 |
| 5,170,025 | 12/1992 | Perry | 219/759 |
| 5,188,256 | 2/1993 | Nottingham et al. | 222/1 |
| 5,275,311 | 1/1994 | Piarrat | 222/105 X |
| 5,305,920 | 4/1994 | Reiboldt et al. | 222/325 X |
| 5,338,911 | 8/1994 | Brandberg et al. | 219/759 |
| 5,397,879 | 3/1995 | Geissler | 219/759 X |

FOREIGN PATENT DOCUMENTS

| | | |
|---|---|---|
| WO92/09503 | 6/1992 | WIPO . |
| WO93/01247 | 1/1993 | WIPO . |

OTHER PUBLICATIONS

U.S. patent application Ser. No. 08/020,662, dated Feb. 22, 1994, Nottingham et al.

U.S. patent application Ser. No. 08/020,511, dated Feb. 22, 1993, Haas et al.

*Primary Examiner*—Joseph A. Kaufman

*Attorney, Agent, or Firm*—Steven J. Hultquist

[57] ABSTRACT

A glue stick article adapted for microwave heating and dispensing of hot melt adhesive material, comprising a container having disposed therein a solid body of hot melt adhesive material having a cross-sectional shape differing from the cross-sectional shape of the container in which the hot melt adhesive material is disposed for microwave heating. Also disclosed is a hot melt adhesive dispensing assembly for microwave heating and dispensing of hot melt adhesive from such glue stick article.

20 Claims, 5 Drawing Sheets

MICROWAVEABLE ADHESIVE CHARGE COMPRISING SHAPED ADHESIVE BODY

BACKGROUND OF THE INVENTION

1. Field of the Invention

The present invention relates generally to a microwaveable adhesive material charge, which is usefully heated by means of microwave radiation, to provide a hot melt adhesive material for dispensing.

2. Description of the Related Art

In the use of hot melt adhesives and other flowable materials which are desirably dispensed in heated condition at the locus of application, the packaging of the heatable, flowable (at least in the heated state) material is an aspect of fundamental importance in the deployment of the material.

Many of such materials immediately prior to their dispensing at the application locus are suitably heated by microwave, ultrasonic, infrared, or other thermal radiation means, to provide the material at the appropriate temperature for the dispensing operation, e.g., in a readily flowable or self-leveling state. For such heating, it is preferable to deploy the material in a heatable form, in a package in which it may also be heated as well as subsequently dispensed.

In the provision of such packaging for sequential storage, heating and dispensing of heated materials, a wide variety of packaging designs has been proposed by the prior art for microwave-heated materials, such as hot melt adhesives which are provided in solid stick form and which under microwave irradiation melt to form a flowable hot melt adhesive medium for bonding and sealant applications.

International Patent Application No. PCT/US91/08661 published 11 Jun. 1992 for "Microwave Hot Melt Adhesive Package and Dispenser," describes a package including a flexible pouch defining a chamber containing the hot melt adhesive, with a dispensing means provided as part of the pouch to permit squeezing dispensing of the hot melt adhesive. The package may include an insulating jacket for facilitating the handling of the package, particularly when the adhesive is in the elevated temperature melt form. The insulating jacket may be formed of polypropylene foam or preferably a foam blend of polystyrene and polyphenylene oxide which may be adhered to and laminated with the microwave transparent layer of the container. In the embodiment shown in FIGS. 1–3 of the patent, the insulating jacket comprises an insulating layer which is heat sealed with a microwave transparent layer at edge portions thereof. The hot melt adhesive employed in such package and dispenser is described to be of varying type (e.g., a water-retaining type which does not require microwave susceptors, or alternatively a type including microwave susceptors in the form of microwave susceptor particles blended or mixed in the hot melt adhesive medium).

International Patent Application No. PCT/US92/05604 published 21 Jan. 1993 discloses a microwave activatable adhesive article including the hot-melt or heat-curable adhesive, and a microwave susceptor layer of at least electrically semi-conductive microwave radiation absorbing material. The susceptor layer is disposed on at least a portion of the substrate, and is responsive to exposure to microwave radiation for raising the temperature of the substrate above a desired level sufficient to melt the substrate.

U.S. Pat. No. 5,188,256 issued 23 Feb. 1993 to J. R. Nottingham, et al. discloses a hot melt adhesive dispenser including a container having hot melt adhesive therein, and a susceptor comprising metal particles adhered to a film such as a high temperature polyimide film, wherein the susceptor is in heat transfer relationship with the hot melt adhesive. The hot melt adhesive container may be formed of a flexible film material having high temperature resistance, and the susceptor may be provided on an interior surface of the container, or otherwise in heat transfer relationship to the hot melt adhesive material. The dispenser disclosed in this patent may further comprise a cover of relatively rigid, heat insulating composite material, such as a foam polystyrene laminated with a bleached hardwood craft paper.

Other hot melt adhesive dispensers are disclosed in copending U.S. patent application Ser. Nos. 08/020,511 now abandoned; 08/020,622 now abandoned; and 08/200,852 now U.S. Pat. No. 5,368,199, which variously disclose dispensers in which microwave susceptors are a component of the container for the hot melt adhesive. U.S. application Ser. No. 08/200,852 discloses the concept of a reusable package or sleeve accommodating receipt therein of a hot melt adhesive container including as a component of the container a microwave susceptor material.

In the use of microwaveable hot-melt adhesive materials, the adhesive medium is typically packaged in solid form, comprising a solid, e.g., tubular-shaped, body of the adhesive solid, in a container of suitable material, such as injection-molded plastic, thin film material, or other packaging material, and the resulting adhesive article is termed a "glue stick."

Glue stick articles in prior art practice have incorporated therein a susceptor (sometimes termed "receptor," the terms "susceptor" and "receptor" being used synonymously in the art to denote a radiation-sorptive, e.g., microwave-sorptive, material which on radiation exposure converts radiation energy to heat), typically as a dispersed material or other component in the adhesive medium, or else as a part or component of the packaging material or other non-adhesive structure of the glue stick.

The glue stick may for example comprise a silicone tube having a microwave receptor dispersed in the silicone material as the container. Such tube may have a solid (hot melt) adhesive body of corresponding suitable size and shape disposed in the tube, with a silicone plug being placed in the open end of the tube, after insertion of the hot melt adhesive stick into the tube, for sealing thereof.

A problem which has arisen in the use of glue sticks of hot melt adhesive is the problem attendant the heating of air present in the glue stick, during the microwave heating of the glue stick. When the glue stick is heated, air, typically trapped at the bottom of the container holding the initially solid adhesive medium, also becomes heated, concurrently with the heating of the adhesive medium.

Such air invariably is present in the container holding the initially solid adhesive medium, being unavoidably incorporated in the container upon loading of the solid adhesive body in the container during the manufacture of the adhesive charge.

As it becomes heated during the microwave heating operation, the trapped air expands, erupting the molten glue, and thereby presenting a disadvantage in respect of the evulsion of molten glue on the surrounding environs, such as the microwave oven in which the glue stick charge is disposed in the receptor.

Further, in glue stick articles such as the silicone tube/adhesive solid body/silicone plug construction illustratively described above, there may be a relatively higher concentration of susceptor (receptor) material at the lower portion of the tube as a result of its fabrication in the described manner. In consequence, heating takes place preferentially in the lower portion of the glue stick during microwaving of the adhesive charge, so that the air trapped in the bottom of the glue stick article is even more highly heated by the concentrated susceptor/receptor material, before substantial heating of the hot melt in the upper regions of the adhesive charge takes place, exacerbating the hot melt adhesive eruption problem discussed above.

It therefore is an object of the present invention to provide an improved microwaveable adhesive charge comprising a container or package in which is disposed a microwaveable adhesive medium.

It is another object of the invention to provide an improved adhesive charge in the form of a glue stick article which overcomes the aforementioned molten glue eruption problem.

Other objects and advantages of the present invention will be more fully apparent from the ensuing disclosure and appended claims.

SUMMARY OF THE INVENTION

In one aspect, the invention relates to a glue stick article comprising a container having disposed therein a solid body of hot melt adhesive material having a cross-sectional shape differing from the cross-sectional shape of the container in which the hot melt adhesive material is disposed, e.g., for microwave heating.

In another aspect, the invention relates to a hot melt adhesive dispensing assembly comprising a housing defining a receiving cavity, and a glue stick article adapted for positioning and heating in the housing cavity, such glue stick article comprising a container having disposed therein a solid body of hot melt adhesive material having a cross-sectional shape differing from the cross-sectional shape of the container in which the solid body of hot melt adhesive material is disposed for heating.

The invention thus contemplates the use of a "disfigured" glue stick to direct or channel the expanding air during heating of the glue stick, so as to avoid eruption of the molten hot melt adhesive.

Other aspects and features of the invention will be more fully apparent from the ensuing disclosure and appended claims.

DETAILED DESCRIPTION OF THE INVENTION, AND PREFERRED EMBODIMENTS THEREOF

The adhesive utilized in the broad practice of the present invention may comprise any suitable adhesive medium, including conventional hot melt adhesive materials, as well as so-called pressure sensitive hot melt adhesives (PSAs). The prior art in the use of PSAs has been unable to provide individual PSA sticks for insertion into traditional hot melt adhesive dispensers, a deficiency which is overcome in the practice of the present invention, in application to such materials, wherein the hot melt material is encased in a charge, as a contained adhesive "glue stick" article.

Figure 1:
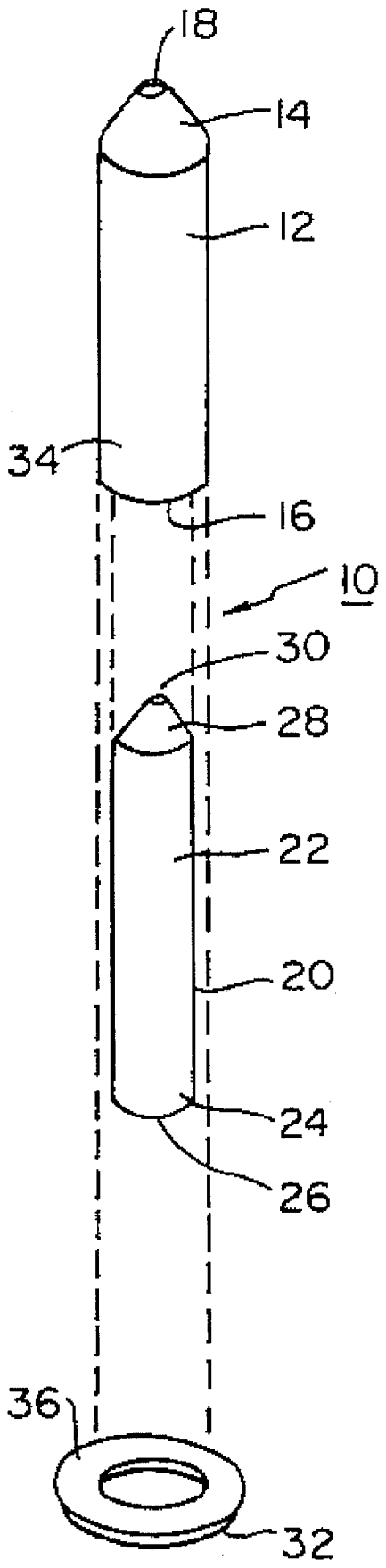
FIG. 1 is an exploded perspective view of a microwaveable adhesive dispensing assembly in which may be utilized an adhesive charge article according to one embodiment of the present invention.

Referring now to the drawings, FIG. 1 is an exploded perspective view of a microwaveable adhesive dispensing assembly 10.

The microwaveable adhesive dispensing assembly includes an insulating sleeve 12 of generally cylindrical form having a conical distal portion 14 and a proximal open end 16 communicating with a central bore of the sleeve and terminating in distal opening 18. The insulating sleeve 12 on its interior surface may have associated therewith interior layers of optional components, such as insulating material layers or liners, susceptor liners, mechanical integrity support liners, temperature-limiting inner sleeves serving coactively with the susceptor layer to limit the maximum temperature of the dispensing assembly when subjected to radiation (e.g., microwave) exposure, etc.

When a separate susceptor liner is present in the dispensing assembly, it is suitably and preferably disposed adjacent the adhesive charge, to provide high efficiency heating of the susceptor material and resultant heat transfer (conductive heating) to the adhesive charge, for melting of the initially solid adhesive material and production of a desired temperature therein for the desired adhesive dispensing operation. With the provision of such a susceptor liner or material surrounding the adhesive charge, and in recognition of the fact that the susceptor under radiation impingement conditions achieves very high temperature, it generally is desirable to dispose a thermally insulating material layer about the susceptor layer, between the susceptor layer and the insulating sleeve, to ensure that the user of the dispensing assembly is adequately protected against thermal burns during the handling and use of the dispensing assembly.

The insulating sleeve 12 is sized and shaped to accommodate insertion into its interior bore of a hot melt adhesive charge 20 comprising a hot melt adhesive medium 22 encased in a container 24 which may be formed of high temperature resistance material. The high temperature resistance material may be in the form of a thin film, or it may be provided in the form of an injection molded material or other preformed material (e.g., an injection-molded silicone tube into which the adhesive material is loaded), it being understood that the container 24 is formable by a wide variety of fabrication processes, and is formable of a wide variety of suitable materials of construction.

In the embodiment shown, the hot melt adhesive charge container 24 is closed at its proximal end 26 and features a conical-shaped distal portion 28 having an adhesive dispensing opening 30 at its distal extremity.

The insulating sleeve 12 in the dispensing assembly shown in FIG. 1 is matingly arranged with respect to base member 32, which as shown may comprise a support having a circular-shaped cavity therein which receives the lower end portion 34 of insulating sleeve 12 therein, whereby the insulating sleeve containing the hot melt adhesive charge 20 may be stably mounted in the base member 32 and surrounded by the upper collar portion 36 thereof, so that the overall assembly may be reposed in unitary fashion in a microwave oven or in proximity to other heating means, for heating of the adhesive medium 22 in the hot melt adhesive charge 20.

The insulating sleeve 12 may be formed of any suitable heat insulating material, preferably a foamed or expanded polymeric material such as polyethylene foam, polypropylene foam, modified polythenylene oxide foam, polystyrene foam, etc., or other suitable insulating material of construction. The insulating sleeve is preferably manufactured from flexible, resilient, relatively deformable materials capable of withstanding high temperatures, for example temperatures of up to 500° F., for periods of time for which the dispensing apparatus is contemplated to be subjected to elevated temperature exposure, e.g., in a microwave oven.

The insulating sleeve provides a cool-to-the-touch structural member which is manually graspable without burning of the user's hands, and the insulating sleeve, being essentially non-heat-transmissive, serves to retain heat in the material being dispensed, thereby extending the period of operability of the dispenser before additional heating is necessary.

The insulating sleeve is, in instances where microwave heating of hot melt adhesive is employed, microwave transmissive (microwave transparent) in character, and capable of maintaining its shape and properties in exposure to the appertaining heating conditions.

In the embodiment shown in FIG. 1, the insulating sleeve 12 is of unitary and seamless character. In contrast to prior art thermally molded insulating sleeves, the insulating sleeve 12 may be shaped at ambient temperatures (ambient here referring to temperatures in the range of from about 0° to about 40° C.).

In consequence of its seamless character, the insulating sleeve avoids the seam splitting and spreading problems of prior art seamed sleeves. Further, because it is shaped at ambient temperature, the insulating sleeve has better shape retention than the prior art seamed insulating sleeves. Further, the seamless sleeve is amenable to ready modification in shape or size, and is amenable to high volume mass production, thus overcoming significant deficiencies of the prior art seamed sleeves.

Figure 2:
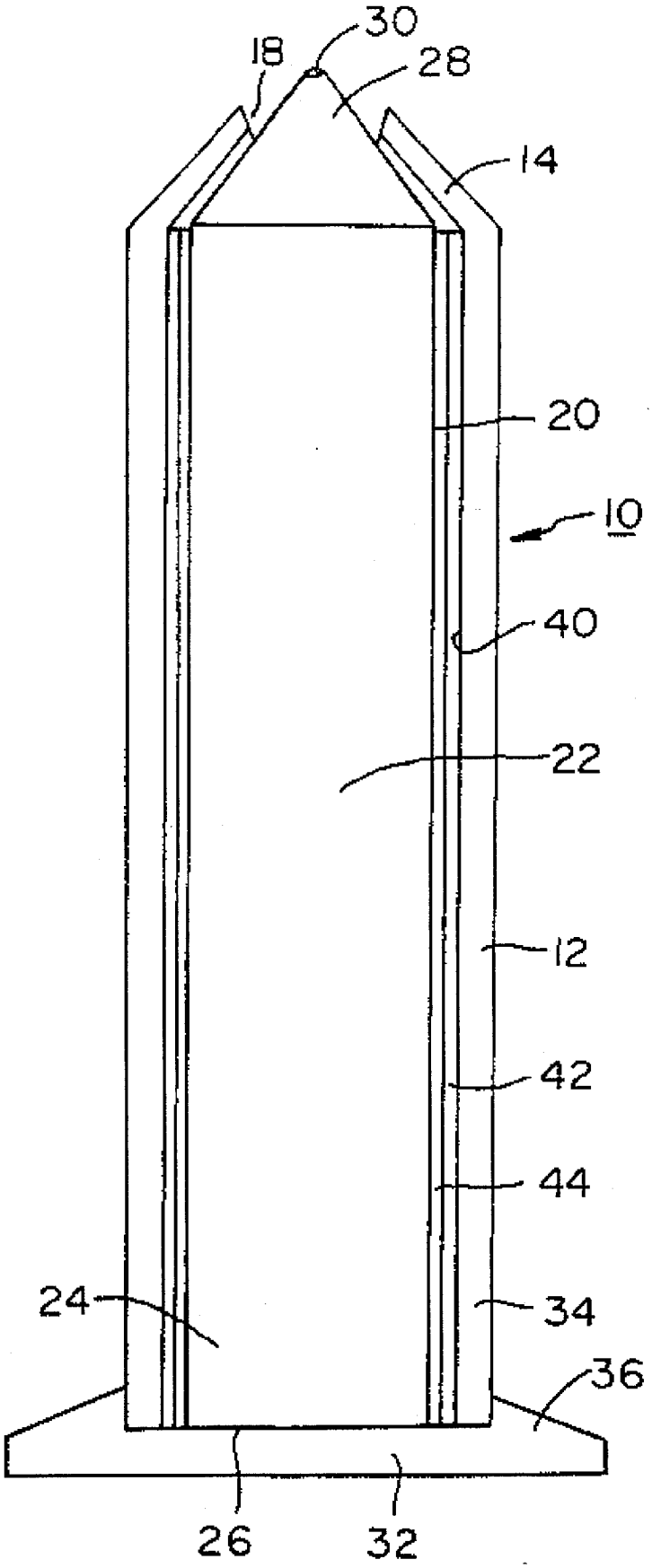
FIG. 2 is a vertical elevation sectional view of the microwaveable adhesive dispensing assembly shown in FIG. 1.

Referring now to FIG. 2, there is shown an elevation view in partial section of a dispensing assembly 10 of the type as shown in FIG. 1. All parts and elements in FIG. 2 are numbered correspondingly to FIG. 1, for ease of description.

As illustrated in FIG. 2, the base 32 of the dispensing assembly includes an upper collar portion for retentive placement of the insulating sleeve 12 therein at the lower portion 34 of the sleeve. The sleeve at its conical distal end portion 14 terminates at distal opening 18, through which the distal conical portion 28 of hot melt adhesive charge 20 upwardly protrudes, so that distal opening 30 of the hot melt adhesive charge 20 is disposed exteriorly of the insulating sleeve 12, to facilitate dispensing of the hot melt adhesive 22 from the charge 20. For such purpose, the sleeve, although relatively rigid, is sufficiently deformable as to allow manual squeezing of the charge 20 by manual pressure exerted compressively on the outer surface of the insulating sleeve 12.

In the dispensing assembly shown in FIG. 2, the inner surface 40 of the insulating sleeve 12 has optionally secured thereto one or more layers, including in the specific embodiment shown in FIG. 2, first layer 42 and second layer 44, it being understood that such layers may be wholly absent and that the container 24 holding the adhesive charge 22 may be in direct abutting contact with the inner wall surface 40 of the insulating sleeve.

The optional illustrated layers 42 and 44 may comprise any suitable respective materials of construction layers as necessary or desirable in a given end use application of the dispensing assembly 10.

For example, one of such layers, e.g., layer 42, may comprise a thermally insulating, non-conductive material layer, such as a fiberglass mat, or a woven or non-woven jacket containing a finely divided particulate-form mineralic insulator material. The other one of such layers, e.g., layer 44, may comprise a susceptor liner of a suitable susceptor (receptor) material of a type known in the art, for the purpose of effecting heating of the hot melt adhesive to a desired elevated temperature. The susceptor may be of a material for is absorptive of microwave or other electromagnetic energy impinged thereon. The thus-heated susceptor is in heat-transmission relationship to the adhesive charge 20, and thereby effects transfer of the requisite heat energy to the hot melt adhesive medium 22.

Preferably, at least one of the additional optional layers is a thermally non-conductive material layer, and most preferably, the outermost of the additional optional layers is a thermally non-conductive material layer, particularly where the inner layer (or one of multiple inner layers) is a susceptor material layer. The susceptor material layer, when present, preferably is located directly adjacent, in contiguous position, to the adhesive charge.

In the event that multiple additional optional layers are provided in the dispensing assembly, e.g., between the adhesive charge and the insulating sleeve, one of such layers may comprise a liner of suitable material imparting enhanced mechanical integrity to the insulating sleeve, or otherwise providing enhanced structural and/or performance characteristics to the dispensing assembly, relative to a dispensing assembly lacking same.

Correspondingly, the interior surface 40 of the insulating sleeve may have associated therewith any other and differing layers, liners, or other materials, efficacious for the storage, heating and dispensing of the adhesive medium or other medium to be dispensed by the dispensing assembly.

By the structure of the insulating sleeve, it is possible to utilize adhesive charges 20 of widely varying character.

In accordance with a preferred aspect of the present invention, the hot melt adhesive charge is devoid of any susceptor material or structure, with the susceptor, if present at all, being associated with the insulating sleeve, or as a separate element or structure of the overall adhesive dispensing assembly.

The charge 20 may, as hereinabove described, comprise a bag or container 24 formed of a suitable material of construction, e.g., a thin film material, or an injection-molded plastic material, for purposes of containing the solid adhesive medium 22 and dispensing of same after being heated to a flowable heated state.

In this respect, it will be appreciated that prior art hot melt adhesive dispensing systems have invariably utilized susceptor materials as a constituent part of the container in which the adhesive medium is disposed. It is correspondingly to be appreciated that such susceptor components constitute a relatively expensive part of the dispensing apparatus, and when utilized in the package comprising the adhesive medium, the charges introduced into the insulating sleeve in such prior art systems, are of a relatively expensive character.

Contrariwise, in the dispensing assembly of the present invention, the susceptor material may be provided in the form of a layer or liner which is affixed to or secured directly or indirectly to the insulating sleeve, whereby the susceptor component is a reusable part of the dispensing assembly. The adhesive charge may correspondingly be devoid of any susceptor structure or component(s).

In use of the dispensing assembly shown in FIGS. 1 and 2, the reusable insulating sleeve assembly comprising optional layers 42 and/or 44, e.g., a fiberglass insulation mat or other layer of thermally non-conductive material as the layer 42, and a liner of susceptor material as the layer 44, is utilized to receive a disposable charge comprising a container 24 of hot melt adhesive medium 22.

The hot melt adhesive in solid form thus may be provided as a "stick" or generally cylindrical article of the solid adhesive medium to be dispensed, contained within a suitable container 24, such as a thin film polymeric material container constructed of a high temperature-resistant material such as polyimide, or of other suitable material known in the art. The sleeve assembly containing the charge then is reposed on the base 32 and disposed in a microwave heating oven at or in proximity to the application locus of use of the hot melt adhesive.

Subsequent to heating of the hot melt adhesive medium to a flowable state, the dispensing assembly, comprising insulating sleeve 12, adhesive charge 20, and base 32, is suitably removed from the microwave heating oven and transported to the locus of use.

At the locus of use, the sleeve assembly may be manually compressed to exert pressure on the adhesive medium 22, via compressive deformation of the insulating liner against the container 24 holding the flowable adhesive medium, to cause issuance of the adhesive through distal opening 30 from container 24.

Subsequent to use of the charge, the material-depleted container 24 may be removed from the dispensing assembly and discarded.

By this arrangement, the adhesive charge is readily mass produceable in a convenient and economic manner, permitting significant cost savings to be realized in the use of hot melt adhesive media.

Figure 3:
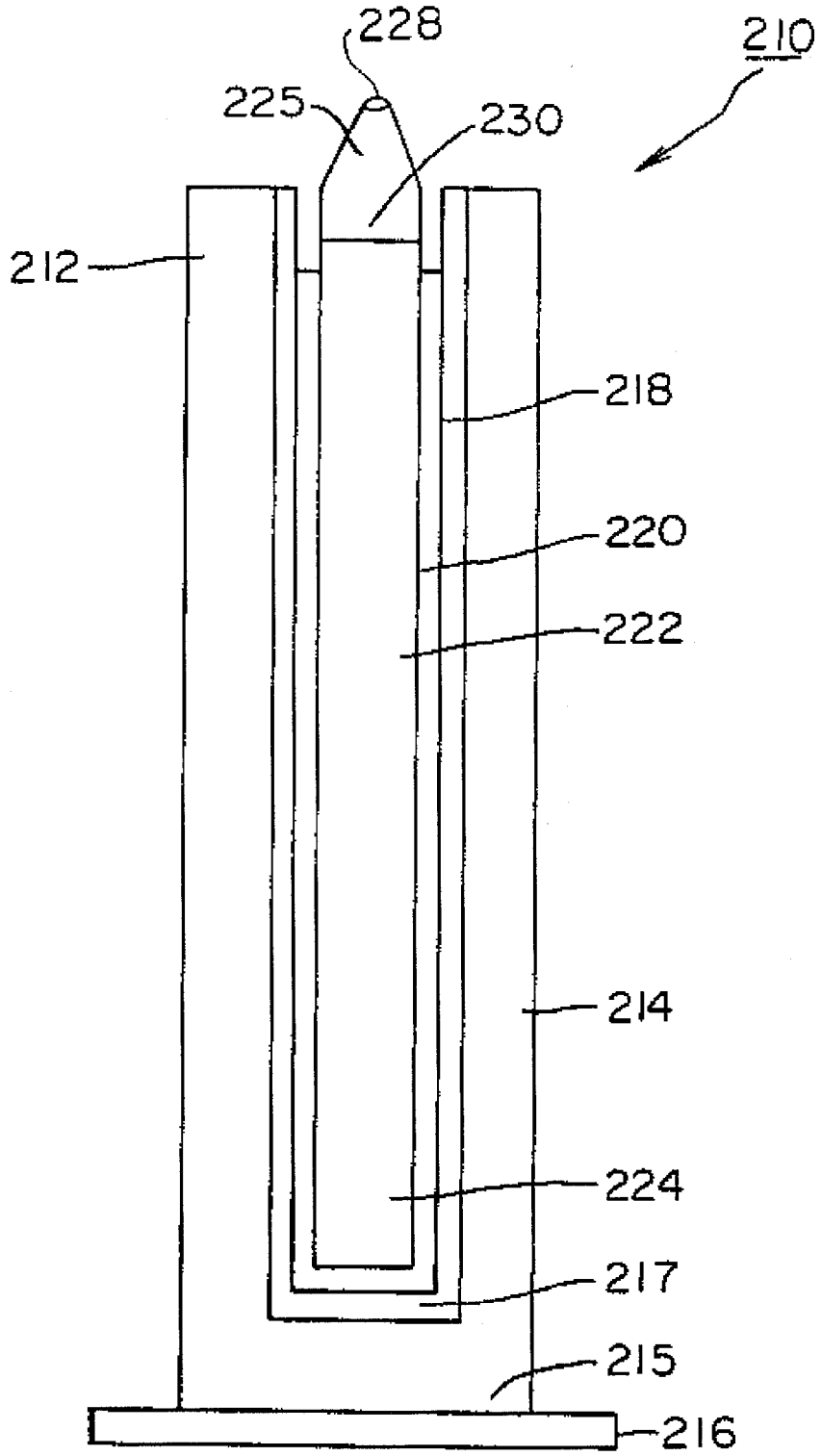
FIG. 3 is a sectional elevation view of a dispensing assembly according to one embodiment of the invention, featuring removable insert members including susceptor means.

FIG. 3 is a sectional elevation view of a hot melt adhesive dispensing assembly 210 according to another embodiment.

The dispensing assembly 210 comprises a vertically upwardly extending insulating sleeve 214 which at its lower extremity 215 is secured to a base member 216. The insulating sleeve may as in the previously described embodiment be arranged for removable mounting on the base member 216, or alternatively, the insulating sleeve 214 may be permanently secured at its lower end 215 to the base member 216, as for example by bonding, mechanical affixation, or the like.

The insulating sleeve 214 thus forms a housing which contains therewithin a cavity 217, as a central bore extending a major portion of the length of the sleeve. The cavity 217 is of cylindrical shape, so that the sleeve in turn is of an annular cylindrical structure, with the exception of the lower portion of the sleeve.

In cavity 217 is disposed a hot melt adhesive charge 222, comprising a container 224 which may be formed of a thin high temperature resistant film material which is microwave-transmissive in character, or of other suitable microwave-transmissive material, being of generally cylindrical shape as shown with a conical-shaped distal portion 226 having an opening 228 at the distal extremity thereof.

The container 224 has disposed therein a hot melt adhesive medium 230, which prior to microwave heating thereof is of solid form, the charge 222 thus being referred to in the art as a "glue stick." The charge 222 is disposed in the cavity 217 in proximity to insert liners 218 and 220. The insert liners 218 and 220 may comprise any suitable elements as necessary or desirable for the microwave heating of the hot melt adhesive 230 in the charge 222. For example, the insert liner 220 may comprise a microwave susceptor material which in receipt of microwave radiation serves to become heated to a high temperature and conductively transfer heat through the heat transmissive container 224 to the hot melt adhesive 230 for melting thereof and heating of the hot melt adhesive to a predetermined elevated temperature.

The insert liner 218 adjacent to insert liner 220 may in turn comprise an insulative medium, such as fiberglass, polymeric foam material, or any other suitable material such as those described illustratively hereinabove as used to form the insulating sleeve in the dispenser assembly of the invention.

In the embodiment shown in FIG. 3, the insert liners 218 and 220 may be readily replaceable or otherwise removable from cavity 217, so that these liners can be withdrawn from the sleeve and discarded in favor of replacement liner elements, as necessary or desirable in the use of the dispensing assembly. For example, a susceptor liner may after some period of use become diminished in heat-absorbing ability, and may desirably be replaced by a new substitute susceptor liner element.

By such arrangement of the dispensing assembly device shown in FIG. 3, the dispensing assembly 210 comprising sleeve 214, base member 216, charge 222, and liner layers 218 and 220, may be manually transported in unitary fashion from the oven or heating locus to the locus of use. At the locus of use, the hot melt adhesive may be selectively dispensed by manual compression exerted on the outer surface of the insulating sleeve 214, which in turn is transmitted through insert liner 218, insert liner 220, and container 224 to exert a pressure force on the contents of container 224 thereby causing the hot melt adhesive to issue from the container through opening 228 at the distal end thereof.

For such purpose, the insert liners 218 and 220 are desirably formed of a resiliently deformable, flexible material, and may be constructed and arranged analogously to the liner layers 42 and 44 in the FIG. 2 embodiment as described hereinabove, with at least one of the insert liners comprising a thermally insulative, non-conductive (of heat) material. The insert liner 218 may as mentioned comprise an insulating material and be of suitable character to accommodate manual compression and deformation, while at the same time providing sufficient thickness to ensure adequate insulative character to prevent burns or discomfort to the hands of a user holding same.

The assembly shown in FIG. 3 in like manner desirably comprises an insert liner 220 of a flexible, deformable character. When insert liner 220 is a susceptor, the liner may constitute a thin film material which is impregnated with or otherwise comprises or contains a microwave-sorptive material as the active susceptor ingredient.

Illustrative of potentially useful susceptor materials in the broad practice of the present invention are materials such as carbon black and particulate ferromagnetic materials such as ferrites, spinels, and spinel ferrites, it being recognized that any suitable susceptor material or materials may be employed, as desired or otherwise appropriate in a given end use application of the invention.

It will be recognized that the insert liners 218 and 220 may be varied and that fewer or greater numbers of insert liner elements may be employed, as necessary or desirable in a given end use application.

In use, the dispensing assembly shown in FIG. 3, is unitarily placed in a microwave heating oven and subjected to microwave exposure conditions for sufficient time to effect microwave heating of the hot-melt adhesive material to a desired use temperature. The dispensing assembly then is removed from the oven and transported to the locus of use, where the heated hot-melt adhesive is selectively dispensed to the locus to be adhesively bonded. At the location of use, the dispensing assembly may be selectively reposed on a suitable support surface during the periods between actual dispensing use, resting on the base portion 216 of the housing structure.

It will correspondingly be recognized that the FIG. 3 dispensing assembly may be widely varied in specific construction and arrangement of insert liner components, as well as the shape and size of the insulating sleeve 214.

As mentioned in the Background section hereof, trapped air in the glue stick may in the course of microwave heating boil and erupt, with consequent adverse affect on the safety of associated personnel and efficacy of the hot melt adhesive dispensing operation.

Additionally, in glue stick articles such as the silicone tube/adhesive solid body/silicone plug construction illustratively described hereinearlier, there may be a relatively higher concentration of susceptor (receptor) material at the lower portion of the tube as a result of its fabrication. In consequence, heating takes place preferentially in the lower portion of the glue stick during microwaving of the adhesive charge, and air trapped in the bottom of the glue stick article then boils, and causes eruption (evulsion) of the molten adhesive material, to an even greater extent than would occur if the susceptor concentration in the container were relatively uniform in character.

The eruption problem attendant the use of solid glue stick charges in microwaveable hot melt adhesive dispensing operations is resolved according to one aspect of the present invention, by the provision of glue sticks which are shaped with a shape providing interstitial or void space along the glue stick in the container of the adhesive charge. Various embodiments of the invention are shown in FIGS. 4–7.

In accordance with the "channelized" glue stick construction of the present invention, the heated air in the lower portion of the adhesive charge channels upwardly, through the channel formed by predetermined shaping of the hot melt stick (to have a differing cross-section than the container wall) before substantial heating of the hot melt in the upper regions of the adhesive charge. As a result, the problems of boiling of adhesive medium and eruption (evulsion) of molten adhesive which have plagued the usage of prior art glue sticks, are avoided in the practice of the present invention.

Figure 4:
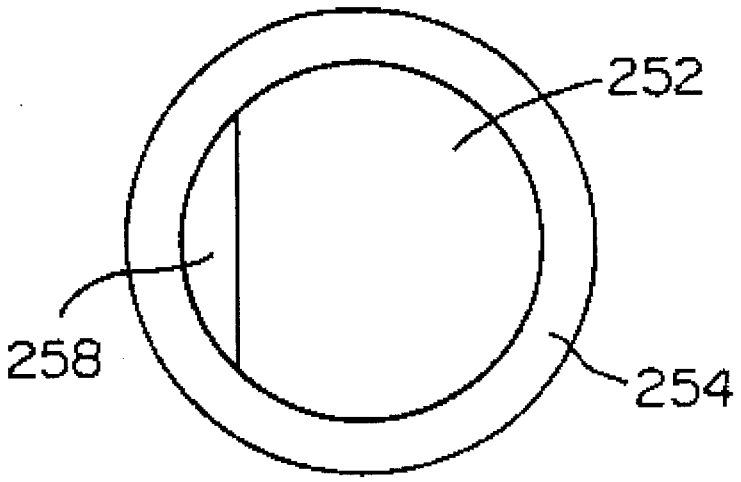
FIG. 4 is a top plan view, in cross-section, of a glue stick article according to one embodiment of the invention.

As shown in FIG. 4, the solid hot melt adhesive stick 252 is encased in thin film container 254 having a cylindrical shape. The view shown in FIG. 4 is a top plan view, in cross-section, it being recognized that the glue stick article typically has a significant aspect ratio of length to diameter, with the length typically being substantially greater than the diameter.

In the FIG. 4 embodiment, the container 254 throughout a major portion of its circumferential extent is in direct abutting contact with the solid adhesive stick 252. At its left-hand portion as shown, however, the solid adhesive stick 252 is formed with a flat edge which is encased by the container wall such that there is a void or interstice 258 between the container wall and the solid adhesive stick at such left-hand portion. The void 258 extends along the length of the glue stick (perpendicular to the plane of the cross-section), along the entire length of the adhesive charge.

In such manner, air in the container upon heating is freely allowed to expand and egress from the container during the microwave heating operation, as the glue stick solid adhesive material is converted from solid to liquid form.

Figure 5:
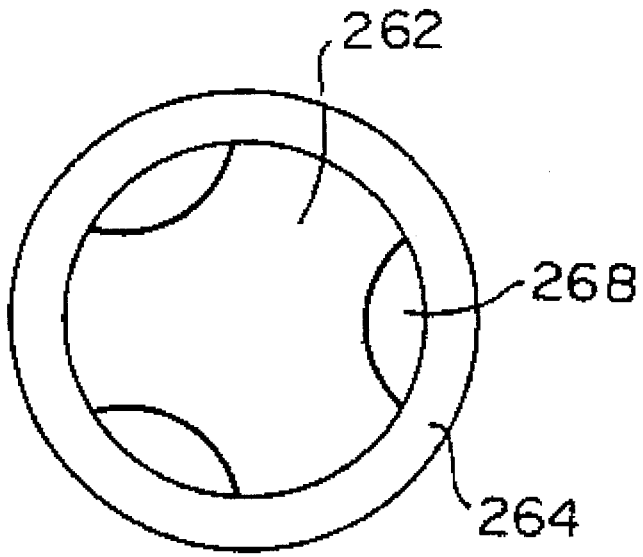
FIG. 5 is a top plan view, in cross-section, of a glue stick article according to another embodiment of the invention.

FIG. 5 is a top plan view, in cross-section, of a glue stick article comprising solid adhesive body 262 having arcuate cutouts at spaced-apart intervals about its circumference, with the solid adhesive body 262 being encased in a casing member 264 which at such cut-out portions is in spaced relationship to the inner wall of the casing member so that the void spaces 268 accommodate heating, expansion, and egress of trapped air in the use of the adhesive charge.

Figure 6:
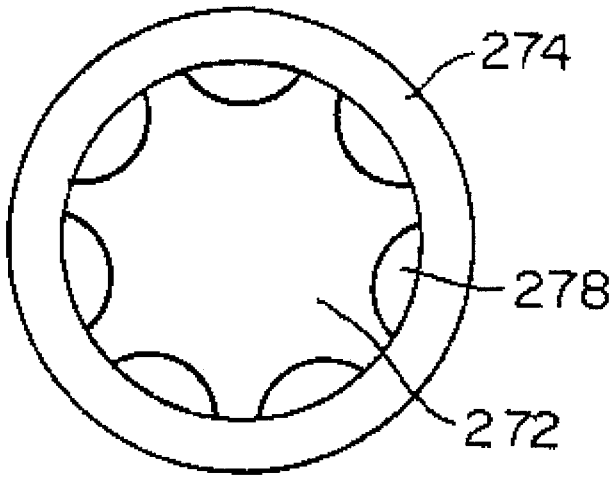
FIG. 6 is a top plan view, in cross-section, of a glue stick article according to a further embodiment of the invention.

FIG. 6 is a top plan view, in cross-section, of another glue stick configuration, in which glue stick comprises a solid adhesive body 272 which is encased by casing 274, having a multiplicity of cut-outs along the circumference of the solid adhesive body, so that the casing 274 at the cut-out is in spaced-apart relationship to the outer circumferential surface of the solid adhesive body, to provide void spaces 278 for expansion and egress of heated air from the adhesive charge.

Figure 7:
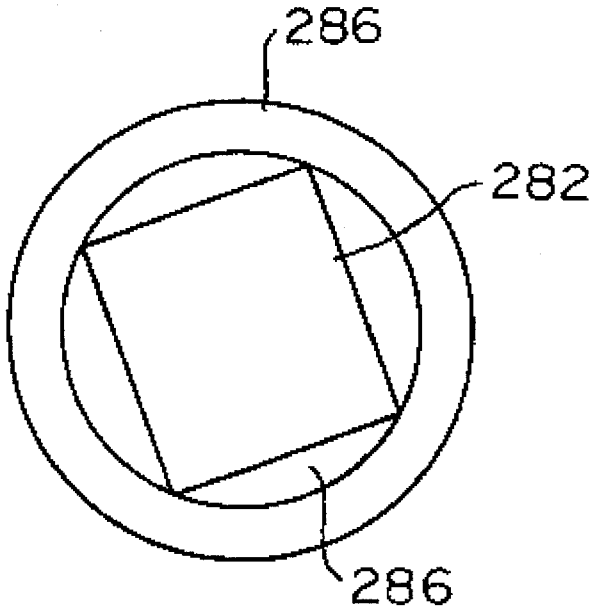
FIG. 7 is a top plan view of a glue stick article according to another embodiment of the invention.

FIG. 7 shows a glue stick 282 comprising a solid hot melt adhesive body of square cross-section, encased in a casing 286 which is in spaced relationship (along the flat sides of the glue stick) to the wall of the casing 286, thereby forming the void spaces 288 about the cross-sectional perimeter of the glue stick article.

While the invention has been described hereinabove with reference to specific features, embodiments, and aspects, it will be appreciated that numerous variations, modifications and alternative embodiments are possible and are contemplated within the spirit and scope of the invention.

What is claimed is:

1. A glue stick article for hot melt adhesive material dispensing, comprising a container having disposed therein a solid body of hot melt adhesive material having a cross-sectional shape (i) differing from the cross-sectional shape of the container in which the hot melt adhesive material is disposed for heating and (ii) forming at least one channel along said solid body of hot melt adhesive material, for expansion and egress of gas from the container through said at least one channel during heating of said solid body of hot melt adhesive material, as said hot melt adhesive material is converted from solid to liquid form.

2. A glue stick article according to claim 1, wherein the container comprises a microwave transmissive material including therein a susceptor component.

3. A glue stick article according to claim 2, wherein the susceptor component is selected from the group consisting of carbon black and ferromagnetic materials.

4. A glue stick article according to claim 1, wherein the hot melt adhesive material includes therein a susceptor component.

5. A glue stick article according to claim 1, wherein the article is devoid of any susceptor structure and any susceptor component therein.

6. A glue stick article according to claim 1, wherein the hot melt adhesive material comprises a pressure sensitive hot melt adhesive material.

7. A glue stick article according to claim 1, wherein the container is formed of a polymeric film material.

8. A glue stick article according to claim 1, wherein the container is formed of an injection molded material.

9. A glue stick article according to claim 1, wherein said cross-sectional shape of said solid body of hot melt adhesive material is a circular shape.

10. A glue stick article according to claim 1, wherein said cross-sectional shape of said container is a non-circular shape.

11. A glue stick article according to claim 1, wherein said cross-sectional shape of said solid body of hot melt adhesive material is a partially circular shape.

12. A glue stick article according to claim 1, wherein said at least one channel is bounded by a flat chordal surface of an otherwise circular cross-sectional shape.

13. A glue stick article according to claim 1, wherein said at least one channel is formed by a concave involution in an otherwise circular cross-sectional shape.

14. A glue stick article according to claim 1, wherein said at least one channel is bounded by a flat surface of said cross-sectional shape of said solid body of hot melt adhesive material, and an arcuate, interior surface of said container.

15. A hot melt adhesive dispensing assembly, comprising a housing defining a receiving cavity, and a glue stick article adapted for positioning and heating in the housing cavity, said glue stick article comprising a container having disposed therein a solid body of hot melt adhesive material having a cross-sectional shape (i) differing from the cross-sectional shape of the container in which the hot melt adhesive material is disposed for heating and (ii) forming at least one channel along said solid body of hot melt adhesive material, for expansion and egress of gas from the container through said at least one channel during heating of said solid body of hot melt adhesive material, as said hot melt adhesive material is converted from solid to liquid form.

16. A hot melt adhesive dispensing assembly according to claim 15, wherein said housing comprises an insulating sleeve having said receiving cavity therein, with said insulating sleeve being formed of a flexible, resilient, deformable, heat insulating material which subsequent to said solid body of hot melt adhesive material having been heated and melted to liquid form, is sufficiently deformable as to allow manual squeezing of the glue stick article, by manual pressure exerted compressively on the insulating sleeve, for dispensing of said hot melt adhesive material in liquid form from said dispensing assembly.

17. A susceptor-free glue stick article, for insertion into an insulating sleeve for microwave heating therein, said glue stick article comprising a tubular container formed of a microwave-transmissive film material and having a circular transverse cross-section, said container containing an elongate solid body of hot melt adhesive material having a transverse cross-sectional shape differing from the cross-sectional shape of the container and forming between the elongate solid body of hot melt adhesive material and container at least one longitudinally extending channel coextensive in length with the elongate solid body of hot melt adhesive material, for expansion and egress of gas from said container through said at least one longitudinally extending channel during heating of said solid body of hot melt adhesive material, as the hot melt adhesive material is converted from solid to liquid form.

18. A susceptor-free glue stick article according to claim 17, wherein said cross-sectional shape of said solid body of hot melt adhesive material is a partially circular shape.

19. A susceptor-free glue stick article according to claim 17, wherein said at least one channel is formed as a concave involution in an otherwise circular cross-sectional shape.

20. A susceptor-free glue stick article according to claim 17, wherein said at least one channel is bounded by a fiat surface of said cross-sectional shape of said solid body of hot melt adhesive material, and an arcuate, interior surface of said container.

* * * * *